United States Patent [19]

Besnier et al.

[11] Patent Number: 4,869,522

[45] Date of Patent: Sep. 26, 1989

[54] COUPLED SAFETY BINDINGS ADAPTED FOR USE WITH MONOSKI

[75] Inventors: Bertrand Besnier; Pierre Rullier, both of Annecy, France

[73] Assignee: Salomon S.A., Annecy Cedex, France

[21] Appl. No.: 65,905

[22] Filed: Jun. 24, 1987

[30] Foreign Application Priority Data

Jun. 25, 1986 [FR] France ..... 86 09637

[51] Int. Cl.[4] ..... A63C 9/085

[52] U.S. Cl. ..... 280/607; 280/625; 280/629; 280/634; 280/14.2

[58] Field of Search ..... 280/601, 607, 611, 617, 280/618, 625, 626, 629, 634, 636, 818, 14.1, 14.2; 441/70, 73

[56] References Cited

U.S. PATENT DOCUMENTS

| | | | |
|---|---|---|---|
| 3,194,574 | 7/1965 | Beyl | 280/625 |
| 3,367,670 | 2/1968 | Salomon | 280/625 |
| 3,802,714 | 4/1974 | Freegard | 280/607 |
| 4,155,569 | 5/1979 | Salomon | 280/625 |
| 4,652,007 | 3/1987 | Dennis | 280/12 H |
| 4,685,696 | 8/1987 | Sedlmair et al. | 280/629 X |

FOREIGN PATENT DOCUMENTS

| | | |
|---|---|---|
| 2536666 | 6/1984 | France . |
| 0621483 | 2/1981 | Switzerland . |

*Primary Examiner*—Charles A. Marmor
*Assistant Examiner*—Brian L. Johnson
*Attorney, Agent, or Firm*—Sandler & Greenblum

[57] ABSTRACT

A binding is provided which includes first and second distinct jaws which are rotatable about respective distinct axes of the body of a binding. The jaws are both biased by a common spring via one or more transverse arms having ends which abut the front portions of the respective jaws. Rotation of one of the jaws, and subsequent release of a boot retained thereby, effects compression of the spring and reduces the release threshold of the other jaw, thereby minimizing injury to a skier.

45 Claims, 5 Drawing Sheets

COUPLED SAFETY BINDINGS ADAPTED FOR USE WITH MONOSKI

BACKGROUND OF THE INVENTION

1. Field of the Invention

The present invention generally relates to safety bindings adapted to be positioned on monoskis in order to maintain two shoes or boots on the monoski, and more specifically to safety bindings which are adapted to have related movements in order to releasably retain such shoes or boots on a monoski.

2. Description of Background and Relevant Material

Conventional safety bindings are known as either "front abutment" types, which are adapted to insure the immobilization of the front portions of shoes or boots on a ski; and other conventional safety bindings are known as "rear abutment" types, which are particularly adapted to maintain the rear ends of a shoe or boot on a ski.

One known front abutment type generally comprises a fixed body which is adapted to be attached to a ski and which includes a retention jaw which is adapted to laterally pivot, either rightwardly or leftwardly, against elastic biasing means to define a release threshold for the binding, i.e., to define a value of the force which must necessarily be provided by the shoe in order to have the shoe or boot be removed from (i.e., released by) the binding. The front abutment insures the safety of the skier by responding, via its lateral release of the boot, to excessive torsional biasing with respect to the leg of a skier. One typical such front abutment is disclosed in French Patent No. 2,536,666 commonly assigned with the present application, the disclosure of which is hereby expressly incorporated by reference herein.

The rear abutment or heel binding generally comprises a jaw which is journalled on a body about a transverse axis so that it is pivotable between a position in which it retains a rear portion of the shoe or boot on the ski, and a position in which it liberates or permits the boot to be freed from the binding. One such known rear abutment binding structure is described, e.g., in French Patent No. 2,494,591. In this patent the rear abutments are generally positioned so as to slide longitudinally and are biased by springs in order to elastically maintain the abutments against the shoes or boots in the longitudinal direction of the ski.

Safety binding apparatus for monoskis generally comprise two independent safety binding assemblies. Each of the assemblies includes a front abutment or binding and a rear abutment or binding for maintaining a ski shoe or boot thereon. Each of the safety binding assemblies is adapted to release under the influence of a bias force exerted on it by the shoe which it retains.

The monoski is generally used with two shoes or boots attached on its upper surface, but on occasion the user will attach only a single shoe to the monoski, with the second shoe remaining free. Such a use is necessary if the monoski is to be used, e.g., on certain mechanical lifts. It therefore becomes necessary that the single shoe attached to the monoski does not release from the ski at an untimely moment, thus separating the skier from the monoski in an undesirable fashion.

However, after a boot or shoe has been either laterally or vertically released from one pair of bindings, the user generally finds himself still connected to the monoski by the other pair of bindings. The forces applied to the leg which is still attached to the monoski by the bindings can then increase and become more substantial, particularly in view of the wide configuration of the monoski, and because the monoski has a higher inertia than an ordinary ski. As a result, the risks of the second leg of the user breaking are thus substantially increased; and it is therefore important to at least substantially reduce the release threshold on the remaining retained leg.

SUMMARY OF THE INVENTION

In a first embodiment thereof, the present invention discloses a safety binding adapted to be attached to a monoski. The binding comprises independent first and second jaws. Each of the jaws comprises means for releasably maintaining one end of respective shoes or boots in a predetermined position on the monoski. The first and second jaws are independently moveable over a stationary binding body, with each of the jaws being mechanically biased into a stable position by an elastic return device. Each of the jaws is capable of moving from the stable position against the biasing force and into a release position in which one end of a respective shoe retained by each of the jaws is released when the shoe exerts a lateral force exceeding a comprises at least one resilient element for mechanically biasing both of the jaws; the elastic return device thereby comprises means for reducing (if not eliminating) the release threshold of one of the jaws when the other of the jaws is moved from its stable maintenance position.

The common elastic element is mechanically attached to the jaws by a linkage assembly which includes a first arm which is substantially transverse to the longitudinal plane of the monoski and which is adapted to be journalled about a first axis to the monoski; the axis is substantially perpendicular to the longitudinal extent of the monoski.

The linkage assembly further comprises a second transverse arm which is adapted to be journalled about a second axis substantially perpendicular to the monoski plane.

The first arm includes a first free end adapted to abut a first jaw, the second arm has a first free end adapted to abut the second jaw, and the first and the second arms can be mechanically journalled with respect to each other.

The first ends of each of the arms are symmetrically positioned about a substantially vertical median longitudinal plane of the monoski. At least one of the arms can be biased by the elastic device, wherein each of the jaws comprises means, when released from its stable position, to simultaneously rotate the two transverse arms against the bias of the common element.

The common elastic element is mechanically attached to the jaws by a linkage assembly comprising a first arm which is substantially transverse to the plane of the monoski and which is journalled about a first axis, and a second arm which is substantially transverse to the monoski and journalled about a second axis.

The first arm includes a first free end adjacent to the first jaw, the second arm having a first free end arms are adapted to be supported by distinct surfaces of a longitudinally slidable support piston.

The binding includes a body portion and the piston is adapted to slide within an opening of the binding body; the arms are biased by the common elastic element such that each of the jaws comprises means, when the jaw releases the respective boot which it retains, for rotating one of the arms and translating the support piston against the force exerted by the common elastic element, the support piston comprising means for separating the other arm and the other jaw by a predetermined clearance.

The common elastic element can be mechanically connected to the jaws by a linkage assembly comprising a piston having a shaft and a head.

The shaft is slidably mounted within a longitudinally extending opening of a binding body, the shaft being biased by the elastic return device. The piston head comprises two extensions substantially transverse to the longitudinal extent of the monoski, each of the transverse extensions terminating in a respective free end, with each of the extensions being adapted to abut a respective one of the jaws.

Each of the jaws is integrally attached to a linkage assembly, each of the jaws comprising two generally angled lateral wings, each of the wings comprising means for transforming lateral biasing of a respective one of the shoes or boots into longitudinal movement of the jaws against the resilient force exerted by the elastic return device.

Each jaw is pivotably mounted on a predetermined portion of the binding body, with each jaw comprising at least one cam surface which is adapted to abut a free end of the linkage assembly and which comprises means for transforming the biasing force exerted by the common elastic element into return torque of the jaw towards a stable maintenance, i.e., boot retaining, position.

The cam surface includes a central flattened portion forming a support surface which is adapted to abut a free end of the linkage assembly when the apparatus is in a stable boot maintenance position. The flattened portion is bordered by first and second lateral zones, with each of the lateral zones comprising a substantially cylindrical or arcuate support surface having a constant radius and comprising means for stably abutting one of the free ends in order to create a stable release position in which the other jaw will not be subjected to any bias by the elastic device. The other jaw will have lateral zones which are not in abutment with the assembly.

Each of the jaws can comprise two independently moveable wings rotatably mounted on the binding body.

In such a case, each of the wings will include a camming surface which is adapted to abut one free end of the linkage assembly and which comprises means for converting the biasing force exerted by the common elastic device into return torque of the independent wings towards a position in which the boots are maintained in a stable position on the ski.

Each of the wings, when biased against the elastic element, comprises means for altering the return threshold of each of the remaining wings.

Each of the jaws comprises an interior wing which is shorter than its exterior wing; and each jaw can include an exterior wing which comprises means for adjusting the spacing and orientation of the exterior wing with respect to the interior wing. The binding can be attached, via a plurality of screws, to the monoski upper surface.

In a second aspect of the present invention, a binding is provided which is adapted to be attached to a monoski. The binding comprises two jaws which are adapted to be spaced apart from each other on the monoski, and means for pivoting each of the jaws with respect to an upper surface of the monoski. Each of the jaws is pivotable into (and away from) a stable position in which it maintains the front of the ski boot or shoe on the monoski. The jaws are moved when the shoe or ski boot retained exerts a predetermined force on the jaw. An elastic return assembly is provided comprising means for exerting a predetermined force on each of the jaws to maintain the jaws in the stable position until a predetermined force acts on the jaws; and means are provided for reducing the force exerted by the elastic return assembly on one of the jaws whenever the other of the jaws is pivoted away from its stable position.

The elastic return means can comprise, e.g., a substantially helical spring. The helical spring is positioned within a bore or recess of a stationary body portion of the binding which is adapted to be fixedly attached to the upper surface of the monoski.

A piston is positioned within the bore and abuts the spring at a first end of the spring, the spring abutting an adjustment mechanism at a second end of the spring. The adjustment mechanism comprises a screw which is threadably connected to the interior of the bore.

The binding further comprises a linkage assembly having a first arm pivotably positioned between the spring and a first one of the jaws, and a second arm pivotably positioned between the spring and a second one of the jaws. A first end of each arm can terminate in a substantially planar plate which is adapted to abut a planar surface of a respective one of the jaws; and an opposite end of each of the arms is adapted to be pivotably connected to an upper surface of the monoski.

The spring contacts each of the arms via a piston, with the piston having at least two distinct support surfaces for contacting the two arms. Each of the jaws is pivotably attached to an upper surface of the monoski, either directly or indirectly via a plate body; and each of the jaws includes a substantially flat planar surface and two generally angled surfaces extending rearwardly towards the rear of the ski when the jaws are attached to the monoski.

Each of the arms is integrally attached at a first end to a respective one of the jaws. At least one of the jaws includes a planar portion and two rearwardly extending wings, one of the rearwardly extending wings comprising at least one portion which is adjustably attached to the wing.

The spring is positioned within a bore in a shaft of the moveable piston, and the piston comprises a unitary member with a head portion adapted to abut a planar surface of each of the jaws.

Each of the jaws may comprise two distinct wing members pivotably mounted to an upper surface of the monoski; the wings are preferably spaced from each other in a direction which is substantially transverse to the longitudinal extent of the monoski.

Each of the wings comprises a generally V-shaped member pivotably attached to the monoski at a first end adjacent to the piston head, and remains unconnected at a rear portion to the upper surface of the ski. Each of the wings is moveable from a first stable position, against the bias of the spring; and each wing includes means for reducing the biasing force of the spring on the other three wings by spacing the piston head from the three wings when each of the wings is pivoted against the bias of the spring.

The jaws are symmetrically positioned about a central median longitudinal plane of the monoski. Each of the jaws, when pivoted, comprises means for simultaneously rotating the two transversely positioned arms forming part of an assembly linking the jaws to an elastic return device.

The rearwardly extending wing portion on each jaw can comprise means for adjusting the position of the portion with respect to the remainder of the jaw.

The piston comprises a first piston surface adapted to abut one of the transversely positioned arms, and a second piston surface is adapted to abut a second one of such arms.

Each of the first and second arms comprises a substantially L-shaped member having a first end pivotably attached to an upper surface of the monoski and a second end in the form of a generally planar contacting element adapted to contact a jaw and thereby form part of a linkage assembly.

One wing of each of the jaws is shorter than the other of the wings. A linkage assembly can comprise two arms positioned generally transversely with respect to the longitudinal extent of the monoski, with each arm having an intermediate portion journalled about a common eccentric pivot.

At least one jaw comprises two rearwardly extending wings, one wing comprising an adjustable rack attached to the jaw by a screw.

BRIEF DESCRIPTION OF THE DRAWINGS

The above and other objects, features, characteristics, and advantages of the present invention will become more fully understood from the attached description of the preferred embodiments which follow in which like reference numerals are used to identify similar parts throughout the several views, in which.

DESCRIPTION OF PREFERRED EMBODIMENTS

Figure 1:
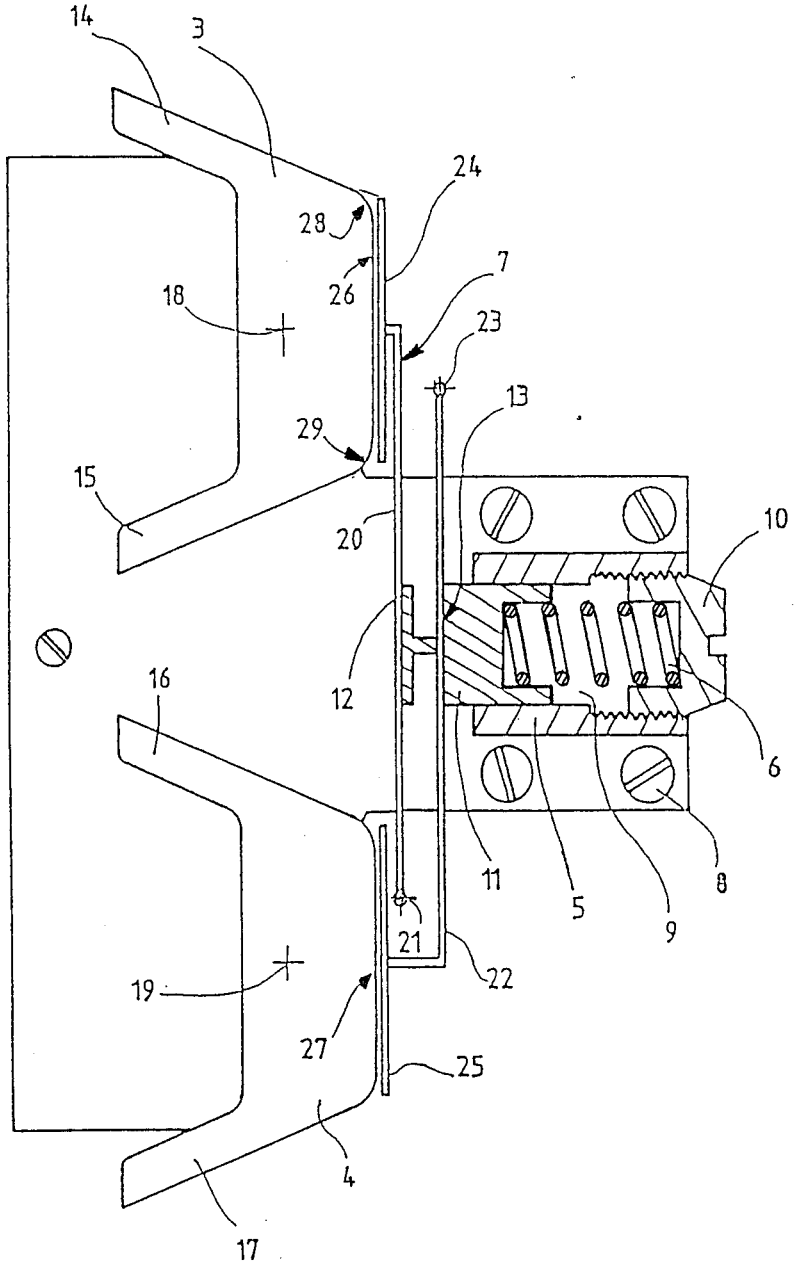
FIG. 1 is a top schematic view, taken in partial cross-section, of a binding formed in accordance with a first embodiment of the present invention.

The present invention has, as one object, avoiding disadvantages of known safety apparatus. The present invention achieves this by providing a novel monoski binding in which the bias forces exerted by one shoe or boot on the monoski will tend to release the first safety binding pair, and simultaneously reduce the release threshold value of a second binding pair. In this fashion, when a first binding releases, the threshold release value of the second binding is reduced, and the risks of breaking the second leg of the user are considerably reduced because the second shoe will then be freed when relatively low bias forces are exerted thereon.

In accordance with another object of the present invention, the release threshold of the second binding is reduced, irrespective of the direction of release of the first binding, i.e., whether it is to the right or to the left. Release of the second binding is facilitated, again either rightwardly or leftwardly, whenever the first binding releases (rightwardly or leftwardly, respectively).

In accordance with another object of the present invention, the release threshold of the second binding will remain low when the first binding releases, even in a situation in which the first shoe or boot has left the monoski and no longer exerts any force on the first binding.

Yet another object of the present invention is to provide a binding which facilitates disengagement of the shoe or boot towards the interior of the monoski, without affecting the other foot, and taking into account the fact that forces exerted by the boot towards the interior of the boot are generally weaker than those exerted outwardly.

A linkage between the two binding assemblies is provided by a relatively simple and reliable mechanical assembly, which is compatible with the principal elements of the abutments or bindings which are presently most often used.

A binding in accordance with the present invention thus makes it possible to maintain the ends of first and second shoes or boots on the monoski, and particularly the front ends and the front soles of these boots or shoes.

In order to achieve both these and other objects, a monoski safety binding in accordance with the present invention comprises distinct first and second jaws which are respectively adapted to maintain one end of each of the first and second shoes or boots in a laterally releasable fashion with respect to the monoski. The first and second jaws are movable independently of each other with respect to a fixed body portion of the binding, and both of the jaws are mechanically biased into a stable state in which they maintain the shoes or boots on the monoski; the mechanical biasing force is provided by an elastic return means.

Each of the jaws is adapted to be spaced from such a stable maintenance position, against the force exerted by the elastic return means, and to thereby attain a release state in order to free the end of the shoe which it retains whenever the shoe or boot exerts a lateral force exceeding a predetermined release threshold which is defined by the elastic return assembly. The elastic return means comprises at least one common resilient element which mechanically biases both of the jaws, so that when one of the jaws is moved from a stable maintenance position under the influence of the bias exerted upon it by a shoe or boot, it will act upon the common elastic element and thereby reduce the release threshold of the other jaw.

In accordance with one embodiment of the present invention, the common elastic element is mechanically attached to the jaws by a linkage element. The linkage element includes a first transverse arm which is journalled about a first axis perpendicular to the flat plane of the monoski, and a second transverse arm which is journalled about a second axis substantially perpendicular to the plane of the monoski. The first arm has a first free end which is associated with the first jaw, and the second arm includes a first free end which is associated with the second jaw. Each of the first and second arms is mechanically journalled with respect to each other so that the first free ends of the arms occupy, in a permanent fashion, symmetrical positions with respect to the longitudinal vertical median plane of the monoski. At least one of the arms is biased by the common elastic element, so that release of one jaw will effect simultaneous rotation of the two transverse arms against the common resilient element.

In a second embodiment of the present invention, the first and second arms rest against a support piston which slides longitudinally within an opening of the binding body and which is biased by the common elastic element. In this fashion, release of one jaw effects rotation of a corresponding transverse arm and translation of the support piston against the common elastic element, with the support piston freeing the other arm and the other jaw to move over a clearance space defined by the course of movement of the released jaw.

In accordance with another embodiment of the present invention, the common elastic element is mechanically attached to the jaws by a linkage element which includes a linkage piston. The shaft of the piston slides within a longitudinal opening of the body of the binding and is biased by the common elastic element. The shaft is integrally attached to a head which includes two transverse extensions terminating in free ends, each of the free ends being associated with respective ones of the first and second jaws.

A plurality of embodiments of the jaw structure can be used with each embodiment of the linkage element or assembly. In accordance with one embodiment, the jaws are integrally attached to the linkage element, with the jaws each comprising two lateral oblique wings which are adapted to change lateral bias exerted by the shoe or boot into longitudinal movement of the jaw against the resilient or elastic return element.

In accordance with another embodiment, each jaw preferably comprises an assembly which can be integrally displaced, and which includes two lateral wings which are configured to retain a boot along its front, sides and top portions. In this case, the jaws are pivotably mounted on appropriate portions of the binding body, with each jaw comprising a shaped portion in the form of a cam which cooperates to support a corresponding free end of the linkage element; and which serves to transform the biasing force of the common elastic element into a return torque of the jaw, i.e., it serves to return the jaw to its stable maintenance position.

In a preferred embodiment, the shape of the jaw includes a central flattened portion which forms a support surface for the free end of the linkage assembly when it is in its stable maintenance position. The flattened portion is bordered or surrounded by first and second lateral zones which form substantially cylindrical or arcuate support surfaces having constant radii so as to define stable release positions for the jaws. In these positions, the other jaw will not be subjected to any bias from the common elastic element.

In accordance with another alternate embodiment, each of the jaws comprises two independent wings which are rotatably mounted on the body of the binding and which are shaped so as to insure maintenance of the front, sides and top of the shoe or boot. Each of the wings comprises a portion in the form of a cam surface which is adapted to cooperate to support a corresponding free end of the linkage assembly and to transform biasing force of the common elastic element into return torque to force each independent wing back towards the stable maintenance position of the shoe or boot. In this fashion, the bias of a single wing changes the release threshold of the three other wings.

The drawings illustrate several embodiments of safety bindings for monoskis formed in accordance with the present invention. Each of these is adapted to maintain the front end of a first shoe or boot (herein used interchangeably) 1 and the front end of a second shoe or boot 2 on the monoski. The binding comprises a first jaw 3 and a second jaw 4, which are independent from each other, and which are independently movable in accordance with a movement pattern with respect to a fixed binding body 5. Jaws 3 and 4 are mechanically biased into a stable boot maintenance position by elastic return means which comprise at least one common elastic or resilient element. In the embodiment shown in the drawings, the common elastic element comprises a compression spring 6 which is mechanically connected to jaws 3 and 4 by a linkage assembly 7.

In the stable maintenance position of the boots which is illustrated in FIGS. 1, 2, 4 and 7, jaws 3 and 4 are illustrated as insuring maintenance of the front portion of the boot forwardly, along both of the right and left sides of the boot, and for preventing the shoe from moving upwardly, i.e., as viewed with respect to the front portions of the soles of shoes or boots 1 and 2. In the release position which is illustrated in FIGS. 3, 5 and 8, one of the shoes or boots (these terms are used interchangeably throughout this application) escapes laterally from a corresponding jaw after such jaw has been displaced against the force exerted by resilient return means 6.

The jaw releases when it is moved from its stable maintenance position over a predetermined distance, thereby permitting the shoe that it retains to escape laterally from the binding. The release threshold is defined as the amount of bias exerted by one boot on the jaw which is necessary for the jaw to release the boot which it holds.

Figure 2:
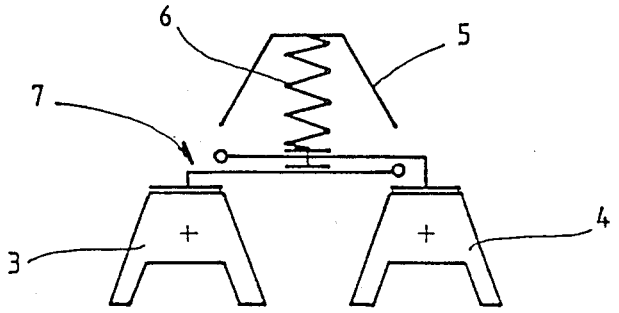
FIG. 2 is a schematic view of the binding of FIG. 1 when in a stable maintenance state.
Figure 3:
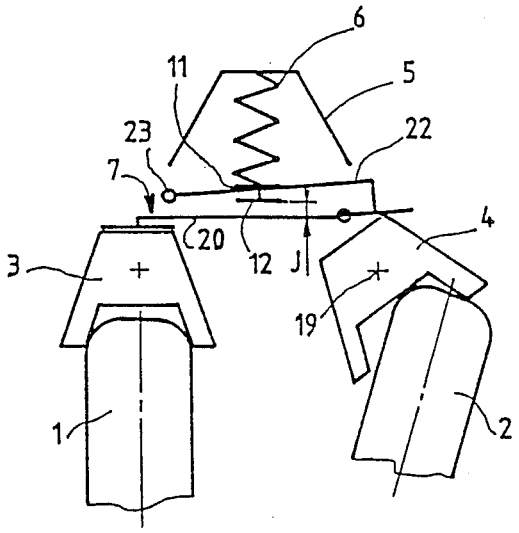
FIG. 3 is a schematic view of the binding of FIG. 1 when the right jaw is in its released position.

In the embodiment illustrated in FIGS. 1–3, fixed binding body 5 is adapted to be attached to the monoski by screws 8. A spring 6 is positioned in a longitudinal opening or bore 9 of body 5, with the first end of the spring being adjustably positioned against an adjustment cap 10 which is screwed into a first tapped or threaded end of opening 9. The second end of the spring is supported against support piston 11, which slides within opening 9 and which extends partially outwardly from the second end of the opening. Support piston 11 comprises a first support surface 12 and a second support surface 13, which surfaces are longitudinally offset from each other.

Jaws 3 and 4 each comprise an assembly which is integrally displaceable, each jaw having two lateral wings 14, 15 and 16, 17, respectively, which are configured so as to insure maintenance of the shoe or boot on the ski along its front, sides and top. The jaws are pivotably mounted, by mechanical pivoting structure, at appropriate positions on binding body 5. In the embodiment shown, jaw 3 pivots about a vertical axis 18, and jaw 4 pivots about a vertical axis 19 of body 5.

Jaws 3 and 4 are connected to spring 6 by a linkage assembly 7 which comprises a first transverse arm 20 which is journalled about a first axis 21 which, is perpendicular to the plane of the upper surface of the monoski, and a second transverse arm 22 which is journalled about a second axis 23 which is similarly positioned in a perpendicular fashion, with respect to the plane of the upper surface of the monoski. First arm 20 includes a first free end 24 which is associated with jaw 3, with second arm 22 similarly having a first free end 25 associated with the second jaw 4. The first free end 24 of first arm 20 rests against front surface 26 of first jaw 3, and the first free end 25 of second arm 22 rests against front surface 27 of second jaw 4. Front jaw surfaces 26 and 27 are similar, with front surface 26 being configured so as to comprise a support cam for a corresponding free end 24 of the arm. The central portion of each of the front surfaces is substantially planar, and tends to position itself transversely with respect to the monoski in order to define the stable maintenance position illustrated in FIGS. 1 and 2. The flattened or central portion of each jaw is bordered by a first lateral zone 28 and a second, substantially rounded zone 29, similar to zone 28. Such a configuration makes it possible to preferably mount jaws 3 and 4 at different positions along the monoski, at varied spacings, which spacings are adapted to result from the specific width of the monoski used.

First transverse arm 20 comprises an intermediate portion which rests against the first support surface 12 of support piston 11. Second arm 22 similarly comprises an intermediate portion which is adapted to rest against second support surface 13 of support piston 11. The support of the intermediate portions of the respective first and second arms 20 and 22 against first and second support surfaces 12 and 13 is provided so as to permit sliding of the intermediate portions of the arms along their respective support surfaces. This sliding motion results from the fact that once a boot is released or a biasing force is effected, piston 11 translates while the arms pivot.

The operation of the device is as follows: as shown in FIGS. 1 and 2, when in the stable maintenance position, jaws 3 and 4 have their wings directed towards the rear of the monoski, and the flattened jaw portions 26 and 27 will be in substantially transverse positions with respect to the monoski, resting against respective free ends 24 and 25 of arms 20 and 22. Compression spring 6 will then push piston 11 rearwardly, with piston 11 in turn pushing arms 20 and 22 against jaws 3 and 4. When lateral biases of relatively low amplitude are exerted by the shoes or boots, jaws 3 and 4 will tend to pivot slightly about axes 18 and 19, and will be repositioned into the stable maintenance position by transforming the pressure exerted by spring 6 into an elastic return torque by the cam which is formed by free arms ends 24 and 25 resting against flattened wing portions 26 and 27, respectively.

As illustrated in FIG. 3, when a substantial lateral bias is applied on right boot 2, second jaw 4 will pivot about its axis 19 and will reach a predetermined release state in which shoe or boot 2 frees itself from the jaw. During pivoting motion, jaw 4 will push the second arm 22 so that the arm will rotate about axis 23, which will compress spring 6 via support piston 11. The first support surface 12 of piston 11 will be spaced, by such piston movement, away from the intermediate portion of first arm 20, and a clearance J is provided between these elements, as best illustrated in FIG. 3. Arm 20 then no longer exerts any mechanical force on jaw 3, which is, accordingly, no longer subjected to the action of spring 6. Rotation of the left jaw 3 is thus facilitated, and the release threshold of this jaw will be considerably lowered, and can even be eliminated if spring 6 is the only elastic return means used. First shoe or boot 1 can then remain in position as long as it exerts no lateral bias, or a lateral bias which does not exceed the new (reduced) release threshold defined by such position of first jaw 3.

Figure 4:
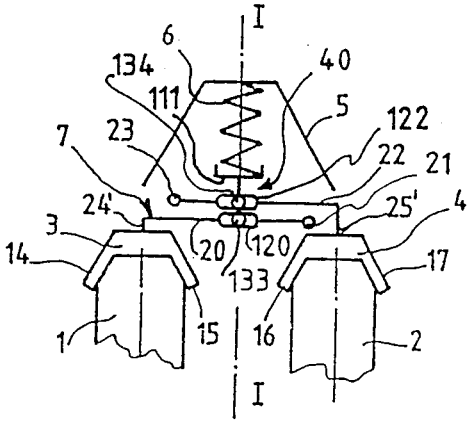
FIG. 4 is a schematic view of a second embodiment of a binding formed in accordance with the present invention, when in its stable shoe maintenance position.
Figure 5:
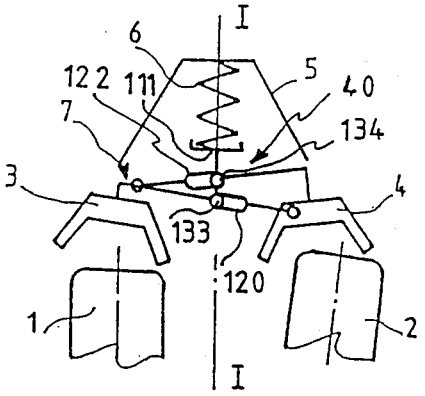
FIG. 5 is a schematic view of the binding of FIG. 4 when the right jaw has released the boot which it retained.
Figure 9:
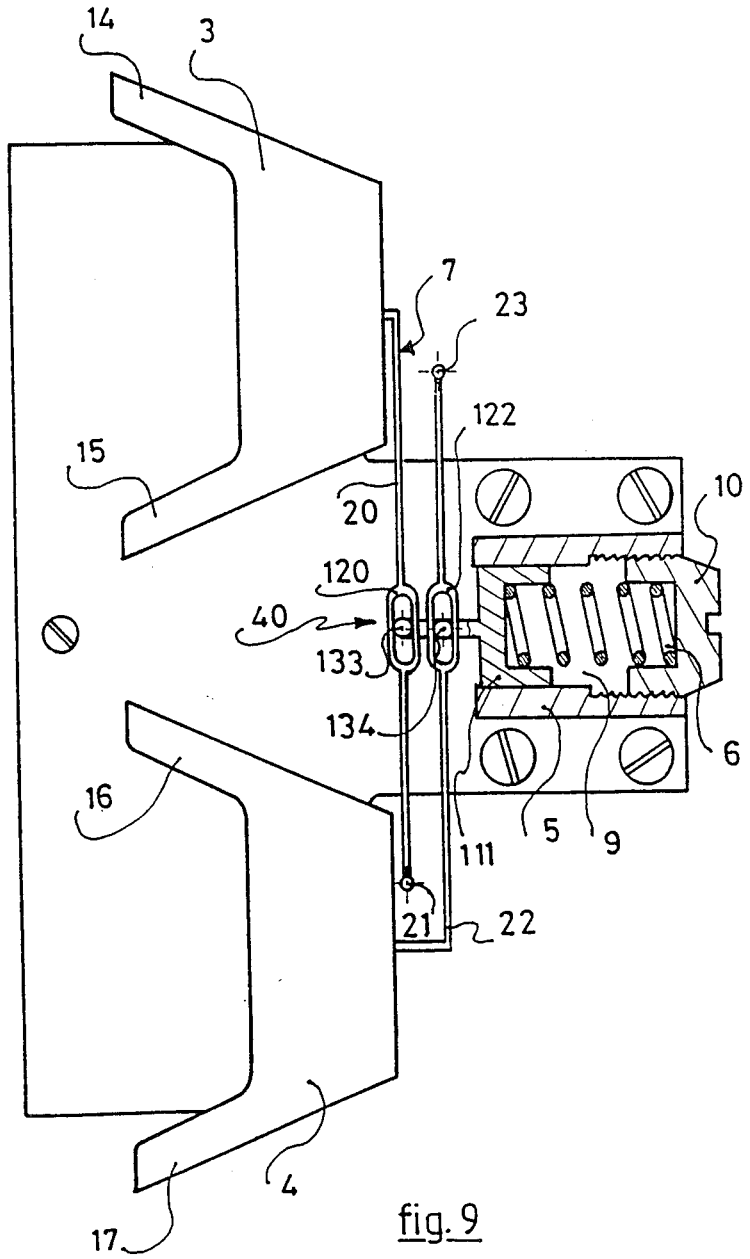
FIG. 9 is a top, schematic view, taken in partial cross section, of a binding formed in accordance with the embodiments of FIGS. 4 and 5.

In the embodiment of the invention illustrated in FIGS. 4, 5 and 9 jaws 3 and 4 are of the same general type as those illustrated in the embodiments of FIGS. 1–3, but are also integrally attached to the jaws via free ends 24' and 25' of first arm 20 and second arm 22, respectively. If necessary, arms 20 and 22 can have adjustable lengths so that the spacing of the jaws can be adapted to the width of the monoski to which they are attached when the bindings are mounted on the monoski. In this embodiment, jaws 3 and 4 thus pivot, respectively, about arm axes 21 and 23. Arms 20 and 22 are journalled, between them, along their intermediate zones, about an eccentric journal 40 shown schematically in FIGS. 4 and 5, which permits them to rotate together at the same times. Journal 40 comprises for each arm 20, 22 an opening 120, 122 in which slides a vertical axis, respectively 133, 134. The two axes 133 and 134 are integrally connected to each other and to the end of spring 6, particularly by means of piston 111 which is itself guided longitudinally in the body 5, as shown in FIG. 9. In this fashion, the free first ends of each of the two arms are permanently positioned in a symmetrical fashion with respect to the longitudinal vertical median plane I—I of the monoski. Compression spring 6 thus rests against an intermediate portion of second arm 22, thereby pushing the two arms 22 and 20 as well as jaws 3 and 4 rearwardly. Rearward movement of jaws 3 and 4 is limited by abutments on the monoski or the binding, or on both (none of which abutments are shown). Lateral wings 14, 15 and 16, 17 of respective jaws 3 and 4 are oblique or angled, as illustrated in the Figures, such that transverse movement of the boots imparts to the jaws a rotational movement about the respective axes 21 and 23.

Operation of the apparatus of these figures is as follows: during a relatively low amplitude lateral biasing force exerted by shoes or boots 1 or 2, jaws 3 and 4, which are subjected to the return force of elastic spring 6, push the shoes or boots rearwardly along the ski, with the shoes being blocked by rear binding elements (not shown in the drawings). As a result, an elastic return torque results which tends to bring boots or shoes 1 and 2 back into the stable maintenance position illustrated in FIG. 4.

FIG. 5 illustrates a position in which right shoe 2 exerts on second jaw 4 a transverse force rightwardly having an amplitude which is sufficient to permit shoe 2 to escape from the jaw and into in a release position. Jaw 4 is then pushed forwardly, against the return force exerted by spring 6, in order to activate movement of jaw 3 via arms 22 and, 20, such that shoe or boot 1 will be relieved or removed from the pressure of spring 6, with jaw 3 being simultaneously moved into its release position.

It should be understood that in the embodiments of FIGS. 1–5, biasing one of the jaws either rightwardly or leftwardly to bring it into its release position similarly changes or effects the position of the other jaw, either reducing (Figs. 1–3) or entirely eliminating (FIGS. 4–5) its release threshold.

Figure 7:
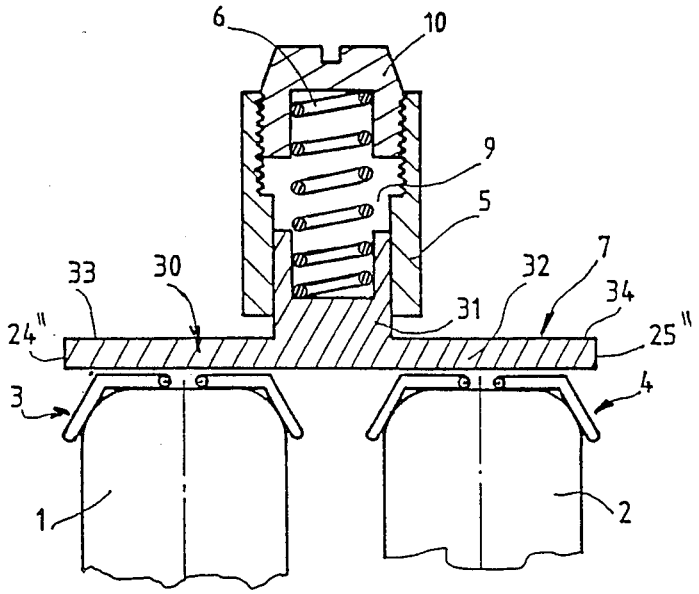
FIG. 7 is a top, schematic, partially sectional view of a binding formed in accordance with another embodiment of the present invention, when in a stable boot maintenance position.
Figure 8:
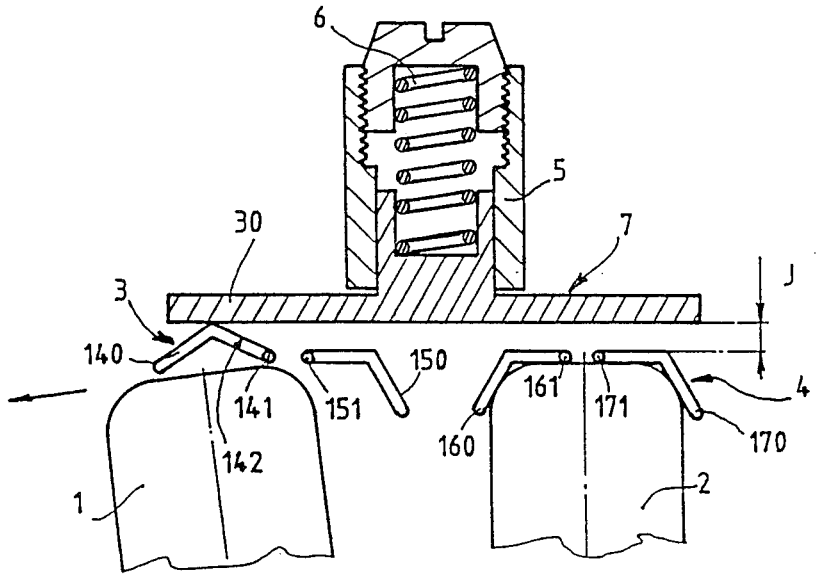
FIG. 8 illustrates the binding of FIG. 7 with the left boot having been released by the binding, i.e., when the left jaw is in the released state.

In the embodiment of the invention illustrated in FIGS. 7 and 8, jaws 3 and 4 each comprise two independently moveable wings. Respectively, these jaws comprise wings, 140, 150, and 160, 170, which are rotatably mounted on corresponding vertical axes 141, 151, and 161, 171 of binding body 4. The wings are shaped so as to ensure forward, side and top maintenance of the shoes on the ski. Each wing comprises a front portion, e.g., front surface 142 of wing 140, which forms a cam surface which is adapted to cooperate to support a corresponding free end of linkage element 7. The linkage element pushes the wings rearwardly, moving them into the stable maintenance position as illustrated in FIG. 7.

In the embodiment illustrated, linkage element 7 comprise a linkage piston 30 having a shaft 31 within longitudinal opening or bore 9 of binding body 5. Shaft 31 is connected to a head 32 in the form of two transverse extensions 33 and 34 which terminate at free ends 24" and 25", respectively, which extensions are respectively associated with first and second jaws 3 and 4. Piston 30 rests against wings 140, 150, and 160, 170 respectively, all of which are pushed by compression springs 6.

Such an assembly preferably makes it possible to vary the distance between jaws 3 and 4 in a manner such as to adapt the jaw to the width of the monoski on which the jaws are mounted.

Operation of the device is as follows: during low amplitude lateral biasing exerted by boots or shoes 1 and/or 2, spring 6 is compressed and pushes the wings rearwardly, towards the stable maintenance position illustrated in FIG. 7.

In the position illustrated in FIG. 8, left boot or shoe 1 is shown as having a relatively large amplitude rotational movement exerted on exterior wing 140, thereby permitting shoe 1 to escape from jaw 3, which is then in a release position. In this position, wing 140 pushes piston 30 by compressing spring 6. The three other wings 150, 160 and 170 are then no longer subjected to the action of piston 30 and spring 6; and their release threshold is, as a result, greatly reduced, or even eliminated. Second jaw 4 then has, as a result, a very low release threshold. Shoe 2 can therefore be freed by the creation of a lateral force of relatively low value.

It should be understood that it is possible to combine the structure in the various embodiments without going beyond the scope of the invention. As one example, it is possible to use jaws having four independent wings, as illustrated in FIGS. 7 and 8, together with a linkage assembly 7 having two transverse arms 20 and 22, as illustrated in either FIG. 1 or in FIG. 4.

Figure 6:
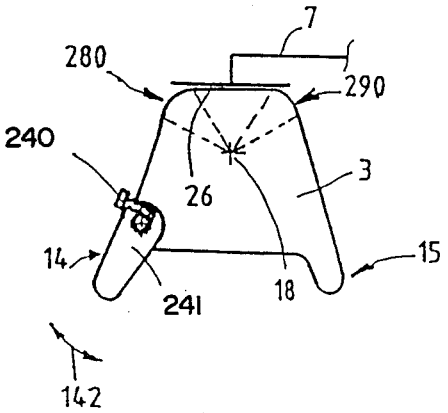
FIG. 6 is a top plan view of the jaw wings in another embodiment of the present invention.

In the embodiments illustrated in which jaws 3 and 4 are rotatably mounted about axes 18 and 19, it is possible to form the axes in different ways, e.g., by using vertical shafts which are integrally attached to body 5 and which engage openings of the jaws, or via support elements which are integral with body 5 on which the jaws are supported by elastic return elements. The jaws are thus indirectly pivoted to the monoski when the bindings are attached to the monoski. In the embodiments in which the jaws are rotatable and rests against a linkage assembly 7, it can be advantageous to shape the jaws as illustrated in FIG. 6, with flattened portion 26 being bordered by two lateral, cylindrical or rounded zones 280 and 290. Each of these zones has a constant radius which is centered about the axis of rotation 18. In this fashion, when linkage element 7 rests on either one of zones 280 or 290, spring 6 will exert no rotational torque on jaw 3. Thus, in a case in which only one jaw is opened, when the corresponding shoe or boot has been disengaged, the jaw will remain in a stable open position and the other jaw will remain in a position in which it is not subjected to the action of spring 6, thus not retaining the boot in such position. The second release is thus facilitated. The zones have a constant radius and similarly make it possible, at the end of the rotation of the jaw towards a release position, to reduce the elastic return torque produced by spring 6, thereby ensuring better disengagement of the shoe or boot at the end of the release.

FIG. 6 similarly illustrates an embodiment of the invention in which the two wings 14 and 15 of each jaw are different. Thus, for one left monoski jaw 3, exterior wing 14 is longer than interior wing 15. In this fashion, the interior wing, which is shorter/ will not interfere in any fashion with the pivoting motion of second shoe 2, i.e., the right shoe, towards the interior of the monoski, i.e., in the direction of or towards left jaw 3. Of course, right jaw 4 must similarly have an exterior wing 17 which is shorter than interior wing 16.

Further, in the embodiment of the invention illustrated in FIG. 6, exterior wing 14 is provided with means for adjusting the spacing, i.e., it is provided with an endless screw 240 which can rotate within the body of jaw 3 and which engages itself in a rack of wing 241 which is rotatably mounted on an axis of the body of the jaw, thereby permitting rotational deflection as illustrated by arrow 142.

The present invention is not limited to the particular means, materials and embodiments disclosed in the specification, but instead it should be clear to all of those of ordinary skill in the art that the invention extends to all equivalents of the specifically disclosed embodiments which are deemed to be within the scope of the appended claims.

What is claimed is:

1. A safety binding adapted to be attached to a monoski, said binding comprising independent first and second jaws, each of said jaws comprising means for releasably maintaining one end of a respective shoe or boot in a predetermined position on said monoski, means for positioning said first and second jaws for independent movement with respect to a stationary binding body, a common elastic return device for mechanically biasing each of said jaws into a stable position, to thereby enable each of said jaws to move from said stable position against a biasing force from said return device and into a release position in which one end of a respective shoe or boot retained by each of said jaws is released when said shoe or boot exerts a lateral force exceeding a predetermined release threshold, said common elastic return device comprising at least one resilient element, each of said at least one resilient element mechanically biasing both of said jaws against their said independent movement with respect to said stationary binding body, said common elastic return device comprising means for reducing said release threshold of one of said jaws when the other of said jaws is moved from its stable maintenance position.

2. A safety binding in accordance with claim 1, wherein said elastic return device is mechanically attached to said jaws by a linkage assembly including a first arm which is substantially transverse to a longitudinal plane of said monoski and which is adapted to be journalled to said monoski about a first axis which is perpendicular to the upper surface of said monoski.

3. A safety binding in accordance with claim 1 wherein said linkage assembly further comprises a second transverse arm which is adapted to be journalled about a second axis substantially perpendicular to said monoski plane.

4. A safety binding in accordance with claim 3 wherein said first arm includes a first free end adapted to abut said first jaw, said second arm having a first free end adapted to abut said second jaw, said first and said second arms being mechanically journalled to each other, the first ends of each of said arms being symmetrically positioned about a substantially vertical median longitudinal plane of said monoski, at least one of said arms being biased by said elastic return device, wherein each of said jaws comprises means, when released from its stable position, to simultaneously rotate said two transverse arms against the bias of said elastic device.

5. A safety binding in accordance with claim 1, wherein said elastic return device is mechanically attached to said jaws by a linkage assembly, said linkage assembly comprising a first arm which is substantially transverse to a longitudinal plane of said monoski and journalled about a first axis, and a second arm which is substantially transverse to a longitudinal plane of said monoski and journalled about a second axis.

6. A safety binding in accordance with claim 5 wherein said first arm includes a first free end adjacent to said first jaw, said second arm having a first free end adjacent to said second jaw, wherein said first and second arms are adapted to abut a longitudinally slidable support piston.

7. A safety binding in accordance with claim 6 wherein said binding has a body portion and said piston is adapted to slide within an opening in said binding body portion, said arms being biased by said elastic return device, each of said jaws comprising means, when each said jaw releases the respective boot which it retains, for rotating one of said arms and translating said support piston against the force exerted by said elastic return device, said support piston comprising means for separating said other arm and said other jaw by a predetermined clearance.

8. A safety binding in accordance with claim 1, wherein said elastic return device is mechanically connected to said jaws by a linkage assembly comprising a piston having a shaft and a head.

9. A monoski safety binding apparatus in accordance with claim 8, wherein said shaft is slidably mounted within a longitudinally extending opening in a body of said binding, said shaft being biased by said elastic return device, said piston head comprising two extensions substantially transverse to the longitudinal extent of said monoski, each of said transverse extensions terminating in a respective free end, each of said extensions being adapted to abut a respective one of said jaws.

10. A monoski in accordance with claim 2, each of said jaws being integrally attached to said linkage assembly, each of said jaws comprising two generally angled lateral wings, each of said wings comprising means for transforming lateral biasing of a respective one of said shoes or boots into longitudinal movement of said jaws against the resilient force exerted by said elastic return device.

11. A monoski safety binding in accordance with claim 2, wherein each said jaw is pivotably mounted on a predetermined portion of said binding body, each of said jaws comprising at least one cam surface which is adapted to abut a free end of said linkage assembly, each cam surface comprising means for transforming the biasing force exerted by said elastic return device into return torque of said jaw towards a stable maintenance position.

12. A safety binding apparatus in accordance with claim 11, wherein said cam surface includes a central flattened portion forming a support surface which is adapted to abut a free end of said linkage assembly when said apparatus is in a stable boot maintenance position, said flattened portion being bordered by first and second lateral zones, each of said lateral zones comprising a substantially arcuate support surface having a substantially constant radius and comprising means for stably abutting one of said free ends to create a stable release position in which a jaw whose lateral zones are not in abutment with said assembly will not be subjected to any bias by said elastic return device.

13. A monoski safety binding in accordance with claim 2, wherein each of said wings includes a camming surface which is adapted to abut one free end of said linkage assembly and which comprises means for converting biasing force exerted by said elastic device into return torque of said independent wings towards a position in which said boots are maintained in a stable position on said ski.

14. A monoski safety binding in accordance with claim 13, wherein each of said wings, when biased against said elastic return device, comprises means for altering the return threshold of each of said other wings.

15. A monoski safety binding in accordance with claim 1, wherein at least one of said jaws comprises an interior wing and an exterior wing, said interior wing being shorter than said exterior wing.

16. A monoski safety binding in accordance with claim 15, wherein at least one of said exterior wings comprises means for adjusting the spacing and orientation of each said exterior wing with respect to each said interior wing.

17. A binding adapted to be attached to a monoski in accordance with claim 1, wherein said binding is attached to said monoski.

18. A binding adapted to be attached to a monoski, said binding comprising:

(a) two jaws which are adapted to be spaced apart from each other on said monoski, and means for pivotably connecting each of said jaws to an upper surface of said binding, each of said jaws being pivotable away from a stable position in which each said jaw maintains the front of a ski boot or shoe on said monoski when said shoe or ski boot exerts a predetermined force on said jaw;

(b) a common elastic return device comprising means for exerting a predetermined force on each of said jaws to maintain said jaws in said stable position until said predetermined force is exceeded on said jaws; and (c) means for reducing the force exerted by said elastic return device on one of said jaws upon movement of the other of said jaws from its stable position toward a position at which said shoe or ski boot is released from said other of said jaws.

19. A binding in accordance with claim 18, wherein said elastic return device comprises a helical spring.

20. A binding apparatus in accordance with claim 19, wherein said helical spring is positioned within a bore or recess of a stationary body portion of said binding, said body portion being adapted to be fixedly attached to the upper surface of said monoski.

21. A binding apparatus in accordance with claim 20 wherein a piston is positioned within said bore and abuts said spring at a first end of said spring, said spring abutting an adjustment mechanism at a second end of said spring.

22. An apparatus in accordance with claim 21, wherein said adjustment mechanism comprises a screw threadably connected to the interior of said bore.

23. A ski binding apparatus in accordance with claim 19, further comprising a linkage assembly having a first arm pivotably positioned between said spring and a first one of said jaws, and a second arm pivotably positioned between said spring and a second one of said jaws.

24. An apparatus in accordance with claim 23 wherein said first jaw and said second jaw comprises a planar surface, and wherein a first end of each arm terminates in a substantially planar plate which abuts a planar surface of a respective one of said jaws.

25. A binding apparatus in accordance with claim 24, wherein a second end of each of said arms is adapted to be pivotably connected to an upper surface of said monoski.

26. An apparatus in accordance with claim 25, wherein said spring contacts each of said arms via a piston, said piston having at least two distinct support surfaces for contacting said two arms.

27. A ski binding apparatus in accordance with claim 23, wherein each of said arms has a first end which is integrally attached to a respective one of said jaws, said arms including intermediate portions which are journalled to each other in an eccentric manner.

28. A binding apparatus in accordance with claim 19, wherein each of said jaws is pivotably attached to an upper surface of a binding body which is adapted to be attached to said monoski, each of said jaws including a substantially flat planar surface and two generally angled surfaces extending towards the rear of said monoski when said binding is attached to said monoski.

29. A binding apparatus in accordance with claim 19, wherein at least one of said jaws includes a planar portion and two rearwardly extending wings, one of said rearwardly extending wings comprising means for adjustably attaching at least one portion of said one of said rearwardly extending wings to said one of said jaws.

30. A binding apparatus in accordance with claim 19, wherein said spring is positioned within a bore in a moveable piston, said piston comprising a head portion adapted to abut a planar surface on each of said jaws.

31. A binding apparatus in accordance with claim 19, wherein each of said jaws comprises two distinct wings which are adapted to be pivotably mounted to an upper surface of said monoski, said wings being spaced from each other in a direction which is substantially transverse to the longitudinal extent of said monoski.

32. A binding apparatus in accordance with claim 31, wherein each of said wings comprises a generally V-shaped member pivotably mounted to said monoski at a first end of said wing, located adjacent to said piston head, and remaining unconnected at a rear portion of said wing to said upper surface of said ski.

33. A binding apparatus in accordance with claim 32, wherein each of said wings is moveable from a first stable position against the bias of said spring, each wing comprising means for reducing the biasing force of said spring on the other three wings by spacing said piston head from said other three wings when each said wing is pivoted against the bias of said spring.

34. A binding apparatus in accordance with claim 18, wherein said jaws are symmetrically positioned on respective sides of a central median longitudinal plane of said monoski.

35. A binding apparatus in accordance with claim 18, wherein each of said jaws, when pivoted, comprises means for simultaneously rotating two transversely positioned arms forming part of an assembly linking the jaws to the elastic return device.

36. A ski binding apparatus in accordance with claim 18, wherein each of said jaws includes at least one adjustable, rearwardly extending wing portion which comprises means for adjusting the position of said portion with respect to the remainder of said jaw to which said portion is attached.

37. A binding apparatus in accordance with claim 21, wherein said force reducing means comprises a first transversely positioned arm for engagement with said first jaw and a second transversely positioned arm for engagement with said second jaw, and wherein said piston comprises a first piston surface for abutting a first transversely positioned arm and a second piston surface for abutting a second transversely positioned arm.

38. A binding apparatus in accordance with claim 37, wherein each of said first and second arms comprises a substantially L-shaped member having a first end pivotably attached to an upper surface of said monoski and a second end in the form of a generally planar contacting element.

39. A binding apparatus in accordance with claim 18, wherein each of said jaws has two wings, one wing of each jaw being shorter than the other of said wings in each jaw.

40. A binding apparatus in accordance with claim 18, further comprising a linkage assembly which comprises two arms which are positioned generally transversely with respect to the longitudinal extent of said monoski, each of said arms having one end pivotably attached to said monoski and another end attached to a respective one of said two jaws, said arms having intermediate portions which are journalled about respective axes which are mounted for common translational movement and for transferring said predetermined force from said elastic return device to said jaws.

41. A binding apparatus in accordance with claim 18, wherein at least one jaw comprises two rearwardly extending wings, one of said wings comprising an adjustable rack portion attached to said jaw by a screw.

42. A binding apparatus in accordance with claim 18 wherein said two jaws are linked to maintain a pair of ski boots or shoes laterally adjacent each other on said monoski.

43. A binding apparatus in accordance with claim 18 wherein said two jaws are engageable with forward portions of respective ski boots or shoes.

44. A binding apparatus in accordance with claim 18 wherein said apparatus is operable with the ski boot or shoe engaged directly on the upper surface of said monoski.

45. A binding comprising:

(a) a first jaw for releasably maintaining a first forward portion of a first shoe or boot in a predetermined position upon a ski and movable between a stable position and a release position and having a predetermined release threshold;

(b) a second jaw for releasably maintaining a second forward portion of a second shoe or boot in a predetermined position upon said ski and movable between a stable position and a release position and having a predetermined release threshold substantially equal to that of said first jaw, wherein said ski has a longitudinal plane, wherein said release threshold of each of said first jaw and said second jaw comprises the force required to move said first jaw or said second jaw in a direction transverse to said longitudinal plane to release said first jaw or said second jaw, wherein said first jaw is positionable on one side of said longitudinal plane and said second jaw is positionable on another side of said longitudinal plane;

(c) means for biasing said first jaw and said second jaw toward their respective stable positions; and (d) means for linking said first jaw to said second jaw for reducing the release threshold of one of said first jaw and said second jaw when the other of said first jaw and said second jaw is moved from its respective stable position.

* * * * *

UNITED STATES PATENT AND TRADEMARK OFFICE

CERTIFICATE OF CORRECTION

PATENT NO. : 4,869,522

DATED : September 26, 1989

INVENTOR(S) : Bertrand BESNIER et al.

It is certified that error appears in the above-identified patent and that said Letters Patent is hereby corrected as shown below:

Column 2, line 25, after "exceeding a" insert —predetermined release threshold. The elastic return means—.

Column 2, line 62, after "end" insert —adjacent to the second jaw, wherein the first and second—;

Column 9, line 3, after "which" delete ",".

Column 10, line 25, change "times" to —time—.

Column 12, line 18, change "/" to —,— after "shorter"; and

Column 13, line 3, change "1" to —2—.

Signed and Sealed this

Twenty-fourth Day of September, 1991

*Attest:*

HARRY F. MANBECK, JR.

*Attesting Officer*

*Commissioner of Patents and Trademarks*